US008727172B2

(12) United States Patent
Burgess et al.

(10) Patent No.: US 8,727,172 B2
(45) Date of Patent: May 20, 2014

(54) CONTAINER WITH DIVIDER

(71) Applicant: Rubbermaid Incorporated, Huntersville, NC (US)

(72) Inventors: Roderick Burgess, Charlotte, NC (US); Liam Timothy Driscoll, Charlotte, NC (US); Timothy Aaron Emig, Concord, NC (US); Thomas E. Hanna, Huntersville, NC (US); Natalia V. Johnson, Cornelius, NC (US); Lauren Briana Mazzio, Concord, NC (US); Britton Mockridge, Roswell, GA (US); Tim Pierzynski, Apple Creek, OH (US); Robert John Warner, Jr., Charlotte, NC (US)

(73) Assignee: Rubbermaid Incorporated, Huntersville, NC (US)

( * ) Notice: Subject to any disclaimer, the term of this patent is extended or adjusted under 35 U.S.C. 154(b) by 0 days.

(21) Appl. No.: 13/661,375

(22) Filed: Oct. 26, 2012

(65) Prior Publication Data

US 2013/0105489 A1 May 2, 2013

Related U.S. Application Data

(60) Provisional application No. 61/552,149, filed on Oct. 27, 2011, provisional application No. 61/638,785, filed on Apr. 26, 2012.

(51) Int. Cl.

| | |
|---|---|
| ***B65D 25/06*** | (2006.01) |
| ***B65D 71/56*** | (2006.01) |
| ***B65D 5/48*** | (2006.01) |
| *B65D 1/24* | (2006.01) |

(52) U.S. Cl.

CPC ..... *B65D 25/06* (2013.01); *B65D 71/0014* (2013.01); *B65D 5/48* (2013.01); *B65D 1/24* (2013.01); *B65D 2501/2421* (2013.01)

USPC ..... 220/533; 220/532

(58) Field of Classification Search

CPC .... B65D 25/06; B65D 25/04; B65D 71/0014; B65D 2501/2421; B65D 1/36; B65D 1/24; B65D 5/48

USPC ..... 220/533, 532, 531, 529, 550, 549, 545, 220/544, 676, 500

See application file for complete search history.

(56) References Cited

U.S. PATENT DOCUMENTS

| | | | | |
|---|---|---|---|---|
| 1,157,045 | A * | 10/1915 | Risher | 220/531 |
| 2,199,740 | A * | 5/1940 | Carney | 249/203 |

(Continued)

FOREIGN PATENT DOCUMENTS

| | | |
|---|---|---|
| EP | 1467933 B1 | 9/2005 |
| EP | 1467933 B9 | 6/2006 |
| WO | 9858116 A1 | 12/1998 |

*Primary Examiner* — Robert J Hicks

(74) *Attorney, Agent, or Firm* — Dennis J. Williamson; Moore and Van Allen PLLC

(57) ABSTRACT

A container comprises a receptacle defining a space where the receptacle comprises a wall having a draft. A divider is mounted to the receptacle such that the divider rotates between a first position and a second position such that when the divider is in the first position the space defines a single space and when the divider is in the second position the divider defines two spaces. In another embodiment a divider is mounted to the receptacle such that the divider translates between a first position and a second position such that when the divider is in the first position the space defines a single space and when the divider is in the second position the divider defines two spaces.

19 Claims, 14 Drawing Sheets

(56) References Cited

U.S. PATENT DOCUMENTS

| | | | | | |
|---|---|---|---|---|---|
| 2,203,240 | A | * | 6/1940 | Tipton | 217/8 |
| 2,257,536 | A | * | 9/1941 | Roycroft | 211/126.1 |
| 2,312,611 | A | * | 3/1943 | West | 220/550 |
| 2,625,973 | A | | 1/1953 | Weldon et al. | |
| 2,895,782 | A | | 7/1959 | Fragale | |
| 3,796,343 | A | | 3/1974 | Polakoff | |
| 3,893,607 | A | | 7/1975 | Jones | |
| 4,057,309 | A | | 11/1977 | Fragale | |
| 4,081,125 | A | * | 3/1978 | Meyers | 229/120.02 |
| 4,577,773 | A | * | 3/1986 | Bitel | 220/533 |
| 4,773,585 | A | | 9/1988 | Lehrman | |
| 4,909,384 | A | | 3/1990 | About | |
| 4,981,232 | A | | 1/1991 | Wynn | |
| 5,078,297 | A | | 1/1992 | Howard et al. | |
| 5,102,208 | A | | 4/1992 | Joynes et al. | |
| 5,114,034 | A | | 5/1992 | Miller et al. | |
| 5,118,173 | A | | 6/1992 | Proctor et al. | |
| 5,234,120 | A | | 8/1993 | Bandera | |
| D350,423 | S | | 9/1994 | Craft, Jr. et al. | |
| 5,472,107 | A | | 12/1995 | Lieber | |
| 5,584,412 | A | * | 12/1996 | Wang | 220/500 |
| 5,690,217 | A | | 11/1997 | Friday | |
| D392,431 | S | | 3/1998 | Schallern | |
| 5,772,058 | A | | 6/1998 | Staesche | |
| D401,024 | S | | 11/1998 | Seymour | |
| 5,873,643 | A | | 2/1999 | Burgess, Jr. et al. | |
| 5,938,059 | A | * | 8/1999 | Luburic | 220/6 |
| 6,015,071 | A | * | 1/2000 | Adomeit et al. | 224/42.34 |
| 6,062,416 | A | | 5/2000 | Smillie | |
| 6,089,394 | A | | 7/2000 | Ziglar | |
| D433,548 | S | | 11/2000 | Baines et al. | |
| 6,488,168 | B1 | * | 12/2002 | Wang | 220/7 |
| 6,761,367 | B2 | | 7/2004 | Fite | |
| 6,805,225 | B2 | | 10/2004 | Freedman | |
| 7,000,798 | B2 | | 2/2006 | Gruennert et al. | |
| D517,264 | S | | 3/2006 | Wheeler | |
| 7,066,647 | B2 | | 6/2006 | Peska | |
| 7,080,653 | B2 | | 7/2006 | Zheng | |
| 7,097,062 | B2 | | 8/2006 | DeRosa | |
| 7,185,801 | B2 | | 3/2007 | Session, Sr. | |
| 7,328,814 | B2 | | 2/2008 | Nordland et al. | |
| 7,587,917 | B2 | | 9/2009 | Gilboe et al. | |
| 8,033,405 | B2 | | 10/2011 | Wang | |
| 2001/0027977 | A1 | | 10/2001 | Hall | |
| 2004/0071371 | A1 | * | 4/2004 | Maher et al. | 383/38 |
| 2004/0140334 | A1 | | 7/2004 | Drane | |
| 2005/0230390 | A1 | | 10/2005 | Glenn | |
| 2006/0231558 | A1 | | 10/2006 | Gayman | |
| 2007/0151307 | A1 | | 7/2007 | Gilboe et al. | |
| 2007/0187912 | A1 | | 8/2007 | Taulman et al. | |
| 2008/0105686 | A1 | | 5/2008 | Cox | |
| 2010/0032431 | A1 | | 2/2010 | Schatz | |
| 2010/0059514 | A1 | | 3/2010 | Zheng | |
| 2010/0270821 | A1 | * | 10/2010 | Ulita | 296/37.14 |

* cited by examiner

CONTAINER WITH DIVIDER

This application claims benefit of priority under 35 U.S.C. §119(e) to the filing date of U.S. Provisional Application No. 61/552,149, as filed on Oct. 27, 2011 which is incorporated herein by reference in its entirety and of U.S. Provisional Application No. 61/638,785, as filed on Apr. 26, 2012 which is incorporated herein by reference in its entirety.

BACKGROUND

Common containers such as laundry baskets, hampers and the like only have one large space for retaining articles such as clothing. As a result, organizing articles in such containers may be difficult because of the lack of separate compartments.

SUMMARY

In one embodiment a container comprises a receptacle defining a space where the receptacle comprises a wall having a draft. A divider is mounted to the receptacle such that the divider rotates between a first position and a second position such that when the divider is in the first position the space defines a single space and when the divider is in the second position the divider defines two spaces.

The receptacle may comprise opposing side walls and a base where the divider is dimensioned such that the divider extends between the opposing side walls in both the first position and the second position. The divider may comprise side edges that extend outwardly from a bottom edge such that when the divider is in the second position the side edges are closely spaced from the opposed side walls along the entire length of the side edges. The side walls may be provided with a draft where the side walls angle outwardly at a draft angle as the side walls extend away from the base. The receptacle may comprise opposing end walls and the base may have a narrowest width at a position between the opposing end walls where the base widens at an angle toward at least one of the opposing end walls at an angle that is the same as the draft angle. The divider may be located at the center of the receptacle such that the container is divided into two equal sized spaces when the divider is in the second position. A cross-sectional shape of the receptacle along the plane of the divider in the second position may be the same shape as the base to one side of the divider. The cross-sectional shape of the receptacle along the plane of the divider in the second position may also be the same as the shape of the divider. The divider may be pivoted on a pivot. The pivot may comprises a pivot pin where the pivot pin may be received in a slot with the pin and slot being dimensioned such that the pin may move in the slot toward and away from the base. A channel may be provided on the base that is dimensioned to closely receive a bottom edge of the divider when the divider is in the second position. The divider may comprise reinforcement ribs that are dimensioned to fit into the channel. A locking mechanism may be provided for holding the divider in the second position and allowing the divider to move toward and away from the base. The locking mechanism may be disposed such that moving the divider towards the base moves the lower edge of the divider into the channel and moving the divider away from the base removes the lower edge of the divider from the channel. The locking mechanism may comprise a first locking member on the divider that engages a second locking member on the container wherein one of the first locking member and the second locking member comprises a channel wherein the divider is able to move along the channel relative to the receptacle.

In one embodiment a container comprises a receptacle comprising a base and a wall defining a space. A divider is mounted to the receptacle such that the divider translates between a first position and a second position such that when the divider is in the first position the space defines a single space and when the divider is in the second position the divider defines two spaces.

The divider may be positioned against an end wall of the receptacle in the first position and may be positioned spaced from the end wall in the second position. A locking mechanism may be provided that locks a bottom portion of the divider relative to the receptacle where the locking mechanism comprises a first locking member on the divider that engages a second locking member on the receptacle when the divider is moved toward the base. A track may be provided for slidably supporting an upper end of the divider where a recess formed in the track is in substantial vertical alignment with the second locking member and the recess receives a portion of the divider when the first locking member engages the second locking member. A plurality of second locking members and a plurality of recesses formed in the track may be provided, one of the plurality of recesses being in substantial vertical alignment with each one of the plurality of second locking members.

DETAILED DESCRIPTION OF EMBODIMENTS OF THE INVENTION

Figure 1:
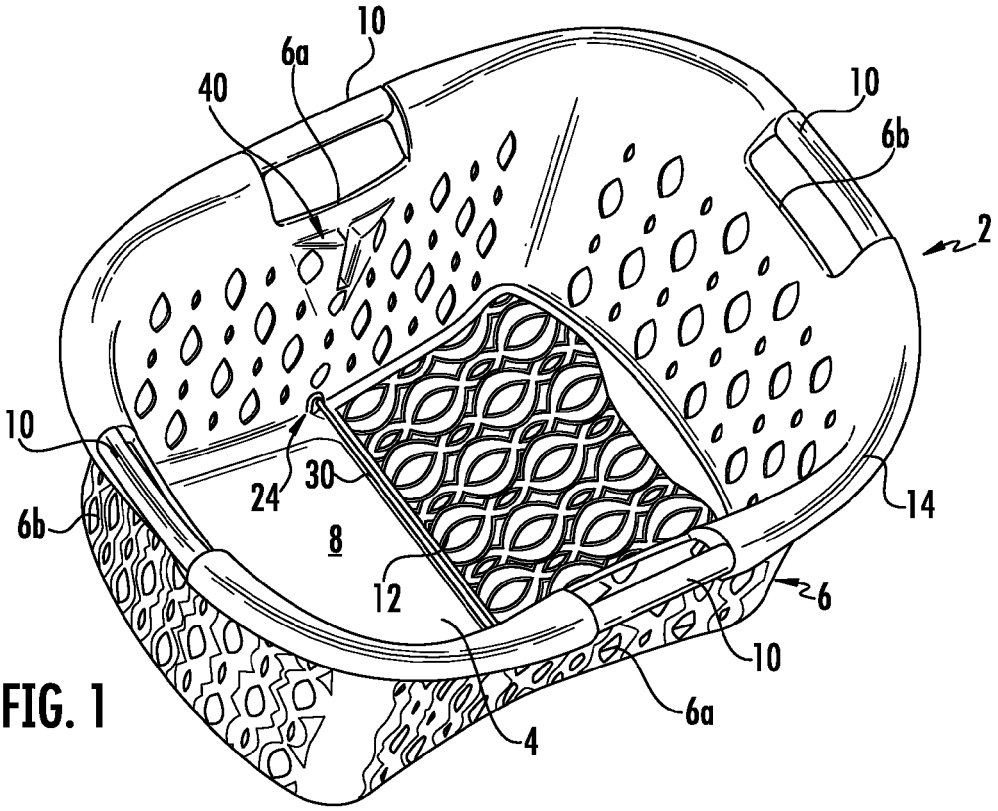
FIG. 1 is a perspective view of an embodiment of a container of the invention.

Embodiments of the present invention will be described more fully hereinafter with reference to the accompanying drawings, in which embodiments of the invention are shown. This invention may, however, be embodied in many different forms and should not be construed as limited to the embodiments set forth herein. Like references numbers are used to refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

Relative terms such as "below" or "above" or "upper" or "lower" or "horizontal" or "vertical" or "top" or "bottom" or "front" or "rear" may be used herein to describe a relationship of one element, area or region to another element, area or region as illustrated in the figures.

The container comprises a receptacle defining an internal space for retaining articles. In some embodiments the container comprises a laundry basket or hamper for retaining articles of clothing. The internal space has a first configuration in which a relatively large space is provided and at least one second configuration in which a plurality of spaces are provided. In some embodiments a single larger space may be divided into a plurality of smaller spaces. The larger space may be divided into a plurality of smaller spaces by a divider that moves between a first retracted position where the large space is undivided and a second deployed position where the divider subdivides the large space into at least two smaller spaces.

Referring to FIGS. 1 through 10 a first embodiment of a container of the invention is shown. The container comprises a receptacle 2 including a base or bottom wall 4 connected to a wall 6 to define an interior space 8. In the illustrated embodiment, the container is a laundry basket intended to carry articles of clothes or other similar articles. While a laundry basket is shown it is to be understood that the container may comprise other than a laundry basket and may be intended to hold a variety of articles. Further, while the wall 6 and base 4 define a generally rectilinear shape where the wall 6 is defined by two opposed side walls 6*a* and two opposed end walls 6*b* the container may have a wide variety of shapes and sizes. The receptacle 2 may be formed of plastic and may be made by a molding operation such as injection molding, blow molding or the like. While in one embodiment the container is made of molded plastic the container may be made of any suitable material. Each of side walls 6*a* and end walls 6*b* may be formed with handles or hand grips 10 to facilitate the carrying of the container. A greater or fewer number of handles 10 may be provided and the handles may be positioned at various locations on the container. The wall 6 may be formed of an open or lattice-type structure, as shown, or it may be a solid structure. The wall 6 may comprise a wide variety of decorative finishes and motifs. Typically, the base 4 is made as a solid member; however, an open or lattice structure may also be used for the base.

Figure 3:
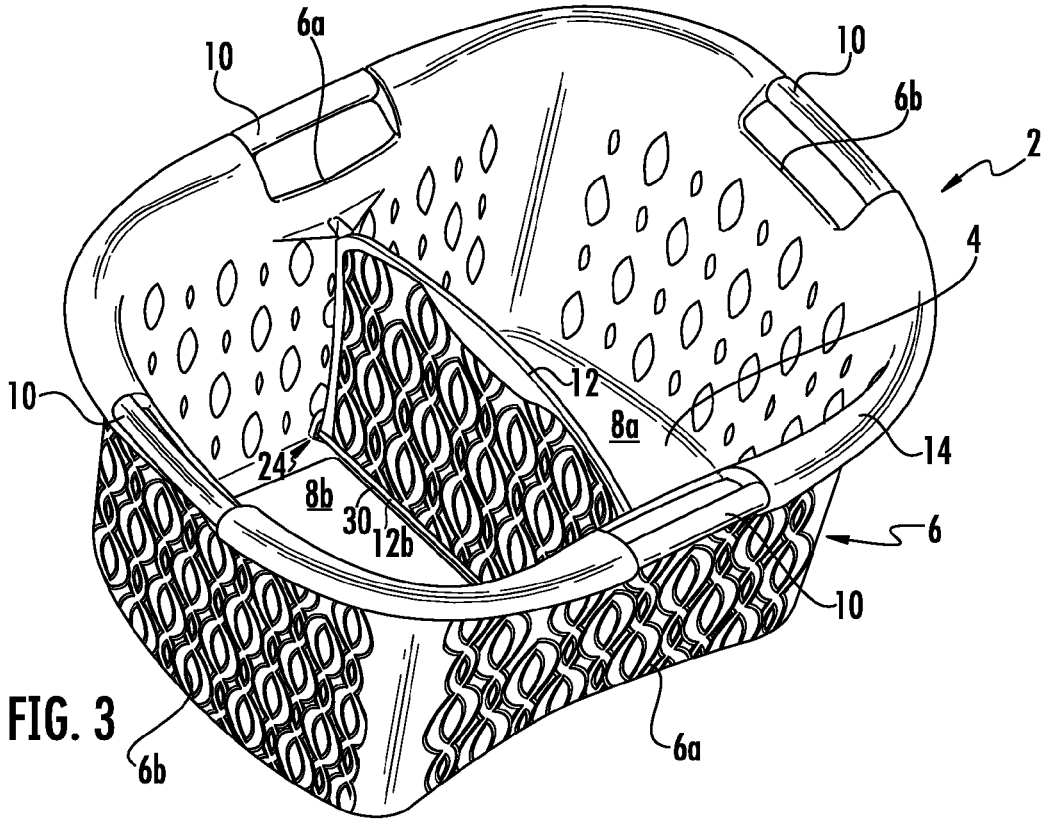
FIG. 3 is a perspective view of the container of FIG. 1 showing the divider in a deployed unlocked position.
Figure 4:
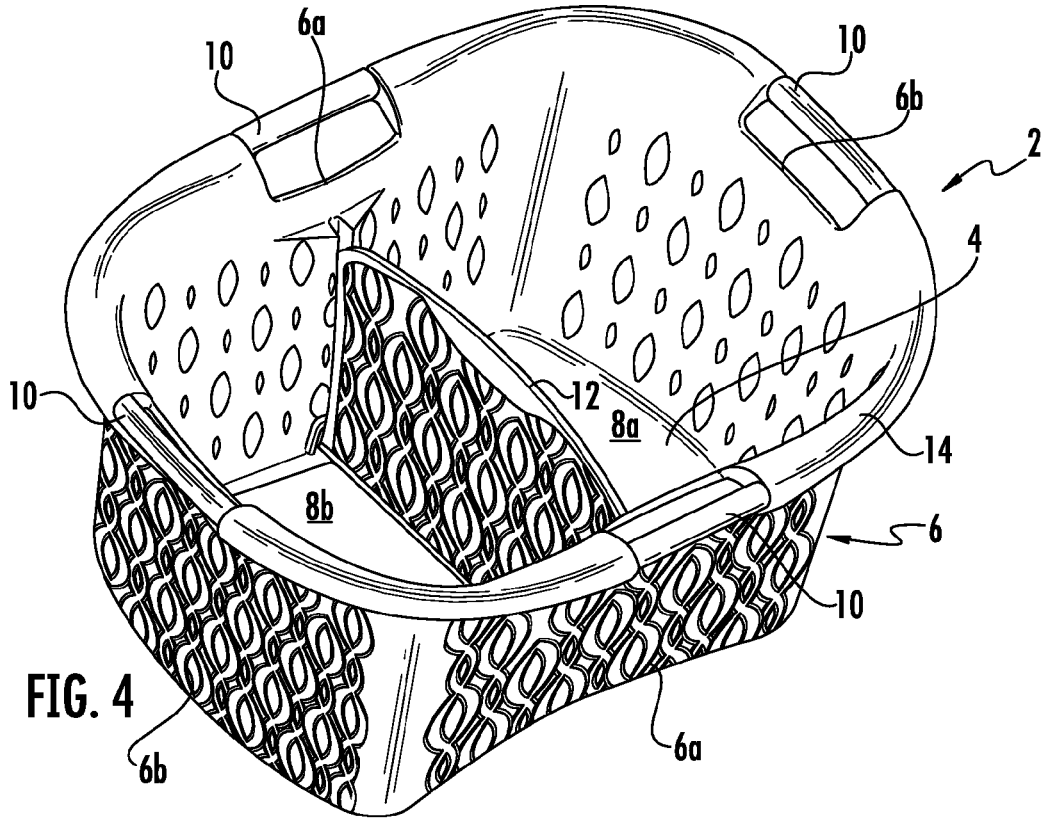
FIG. 4 is a perspective view of the container of FIG. 1 showing the divider in a deployed locked position.

The container further comprises a movable divider 12 that may be used to subdivide the interior space 8 into two or more compartments or subspaces 8*a* and 8*b* (FIGS. 3 and 4) such that the container may be used to segregate articles in the plurality of subspaces. In one embodiment, the divider 12 comprises a generally planar member that is mounted for movement relative to the container such that it may move between a first retracted or storage position where the interior space is maintained as a single, large undivided space and a second deployed position where the interior space 8 is subdivided into a plurality of compartments or subspaces 8*a* and 8*b*. In the illustrated embodiment, the divider 12 is mounted for pivoting movement such that in the first retracted position the divider 12 lays flat against the base 4 of the receptacle 2 (FIG. 1) and in the second deployed position the divider 12 extends substantially perpendicularly from the base 4 (FIG. 4). While in one embodiment, the divider is disposed substantially perpendicular to the base 4 in the deployed position, the divider may be supported at other than a right angle.

The divider 12 is dimensioned such that the divider extends between the opposing side walls 6*a* to divide the receptacle 2 into two separate spaces 8*a* and 8*b*. The receptacle 2 may be provided with a slight draft where the upper rim 14 of the receptacle 2 is longer and wider than the base 4 such that the wall 6 angles outwardly as it extends away from the base 4. The container of the invention may be nested with other similar containers, such as during shipment and/or storage. Nesting is achieved by forming the wall 6 to have a draft such that a substantial portion of one basket may fit within the interior of another basket (and so on). A slight draft angle of the wall 6 may also be necessary for the manufacture of the container if the container is made by a molding operation, such as by injection molding plastic.

Figure 5:
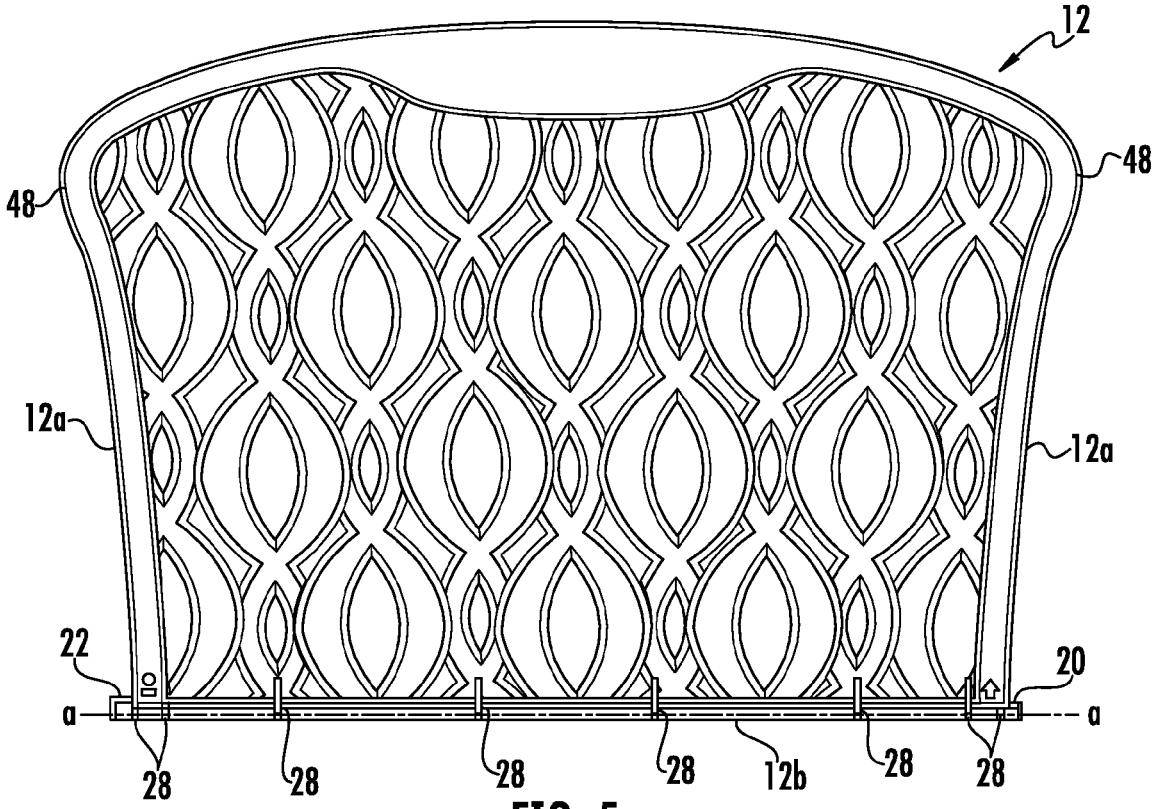
FIG. 5 is a side view of an embodiment of a divider usable in the container of FIG. 1.
Figure 6:
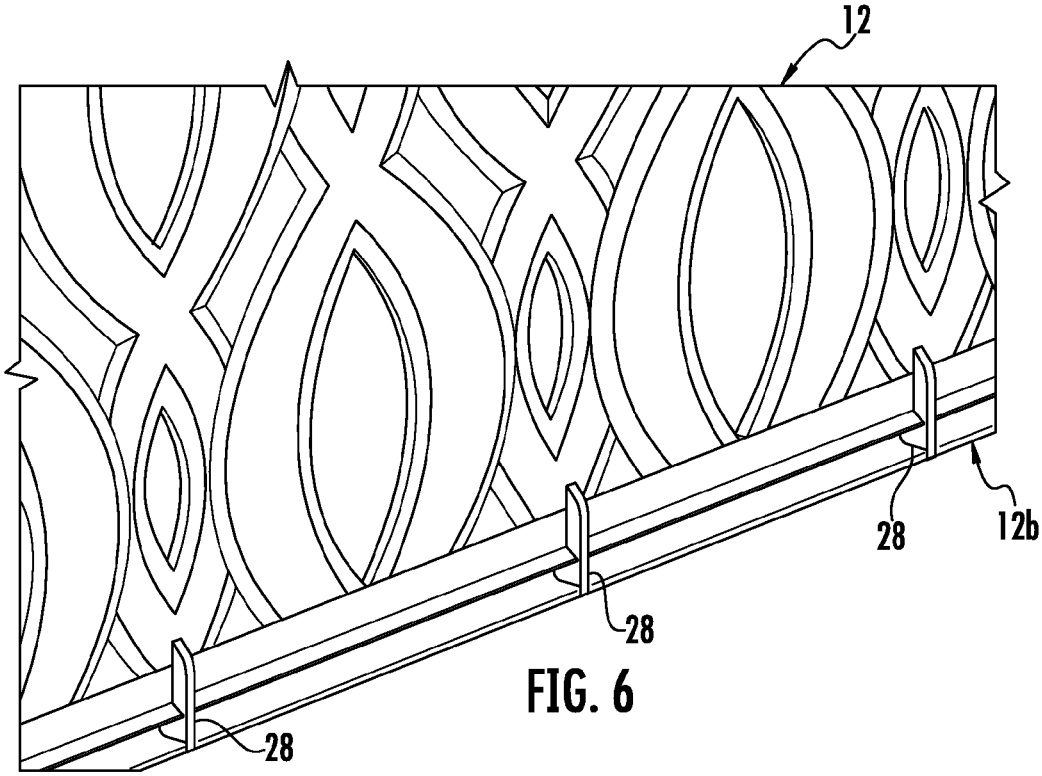
FIG. 6 is a detailed perspective view of the divider of FIG. 5.
Figure 7:
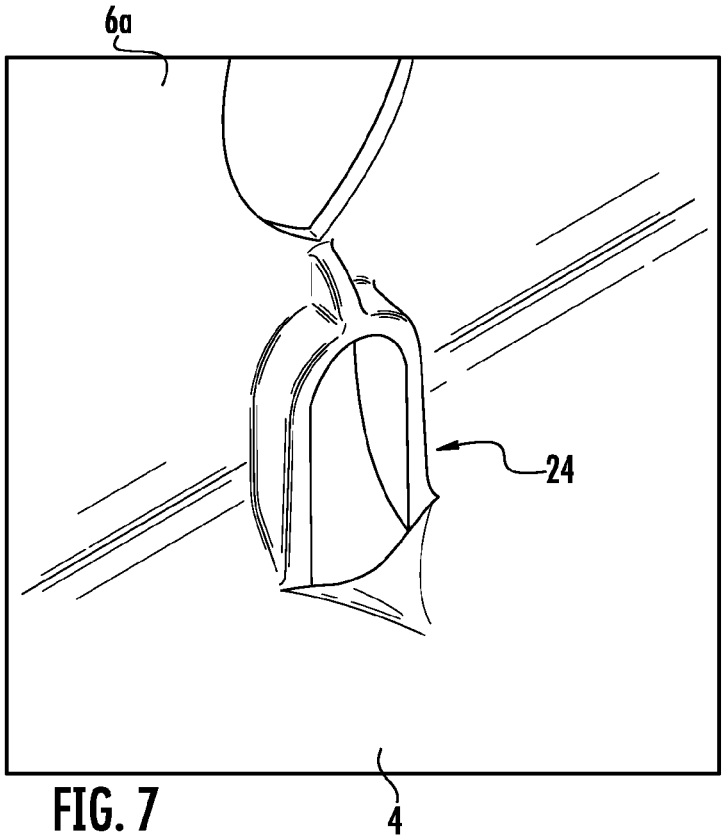
FIG. 7 is a detailed perspective view of the receptacle used in the container of FIG. 1.
Figure 8:
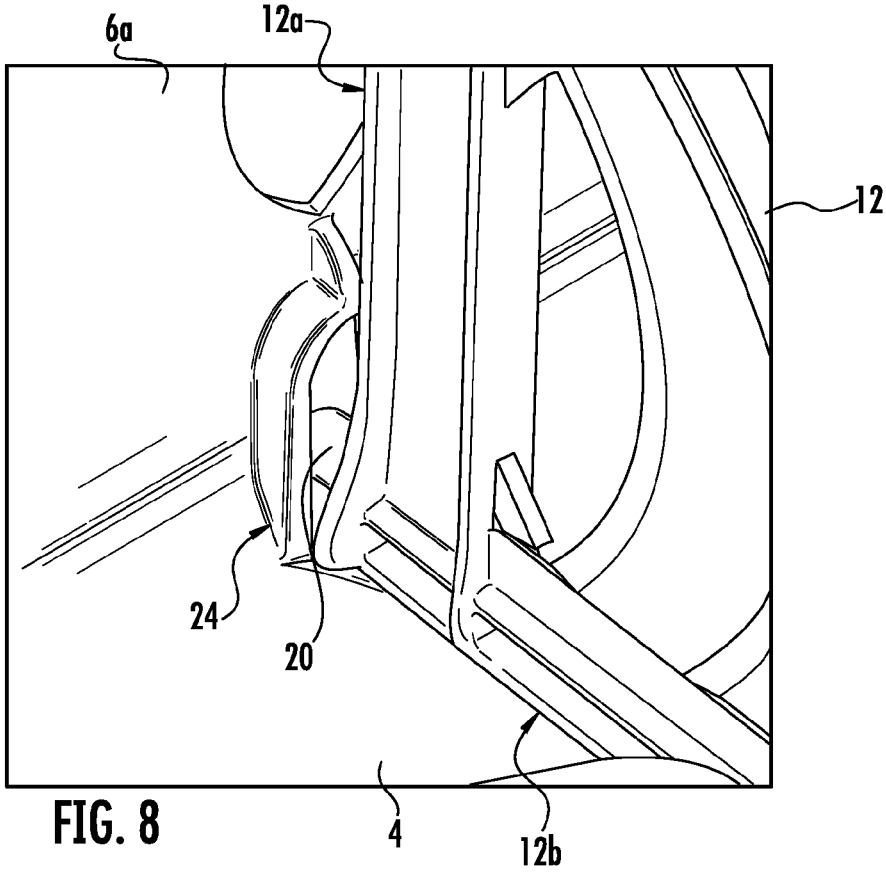
FIG. 8 is a detailed perspective view of the container of FIG. 1.
Figure 9:
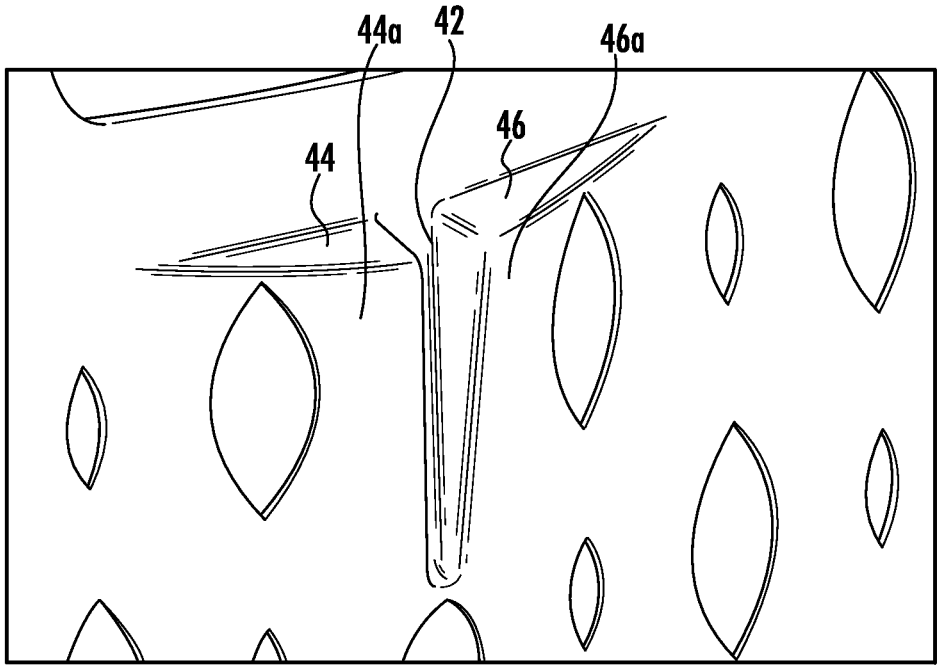
FIG. 9 is a detailed perspective view of the receptacle used in the container of FIG. 1.
Figure 10:
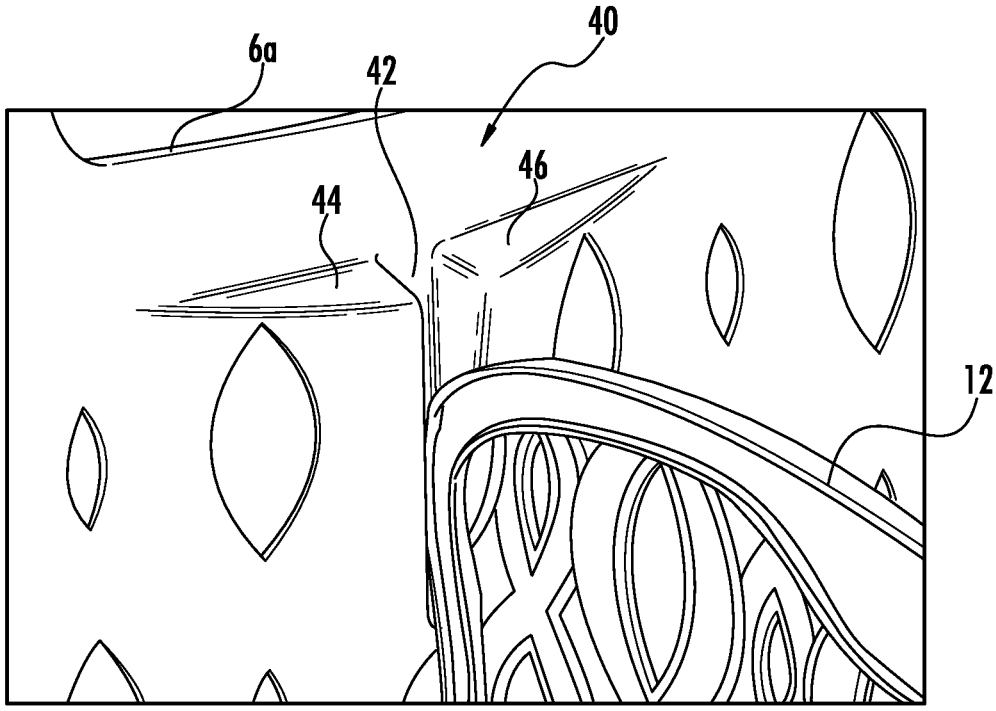
FIG. 10 is a detailed perspective view of the container of FIG. 1.

Referring to FIG. 5, the divider 12 may be made with a complementary shape to the interior of receptacle 2 such that the divider, when in the extended position extends completely between the opposed side walls 6*a*. The side edges 12*a* of the divider 12 may extend outwardly from the bottom edge 12*b* toward the top edge 12*c* such that the angle of the side edges 12*a* to the bottom edge 12*b* corresponds to the draft angle of the side walls 6*a*. As a result, when the divider is in the deployed position the side edges 12*a* are closely spaced from the opposed side walls 6*b* of the receptacle 2 along the entire length of the side edges 12*a*.

The container as shown and described herein provides a divided container which can also be nested such as during shipment and/or storage by forming the sidewalls to have a suitable draft. Providing a divider that is pivotable, or otherwise moveable, relative to the receptacle requires shaping the basket and the divider so that each have a unique shape to accommodate the divider when it is located in the storage position at the base of the receptacle and when is is located in the deployed position. Traditional containers, such as laundry baskets, typically have side walls that are flat or otherwise lie along the same plane (or curved only on one side for more ergonomic fit when carried). However, placing a divider in such a container would not allow the divider to be positioned at the base because the base shape is not the same size and shape as the internal wall. Thus, in the typical configuration, a divider that fits between the side walls would not fit into the base and vice versa.

Accordingly, as shown and described herein, the new container shape has been configured to have a bow-tie or hour glass shape where the shape of a portion of the base approximates the cross-sectional shape of the receptacle along the plane of the divider in the deployed location. In one embodiment, the base may be designed to have a more narrow width at or near its center point (or any other point at which a divider is to be placed) and increasing in width toward either end wall or both end walls (thereby providing the bowtie or hourglass shape). The sidewalls of the receptacle of the invention may extend at an angled direction outward from all along the periphery of the base to provide sufficient draft to allow nesting, as desired. The angle may be selected to allow the divider to pivot from its non-use storage position in the bottom of the basket to its deployed position. FIGS. 1-4 illustrate an example of this general shape.

Figure 2:
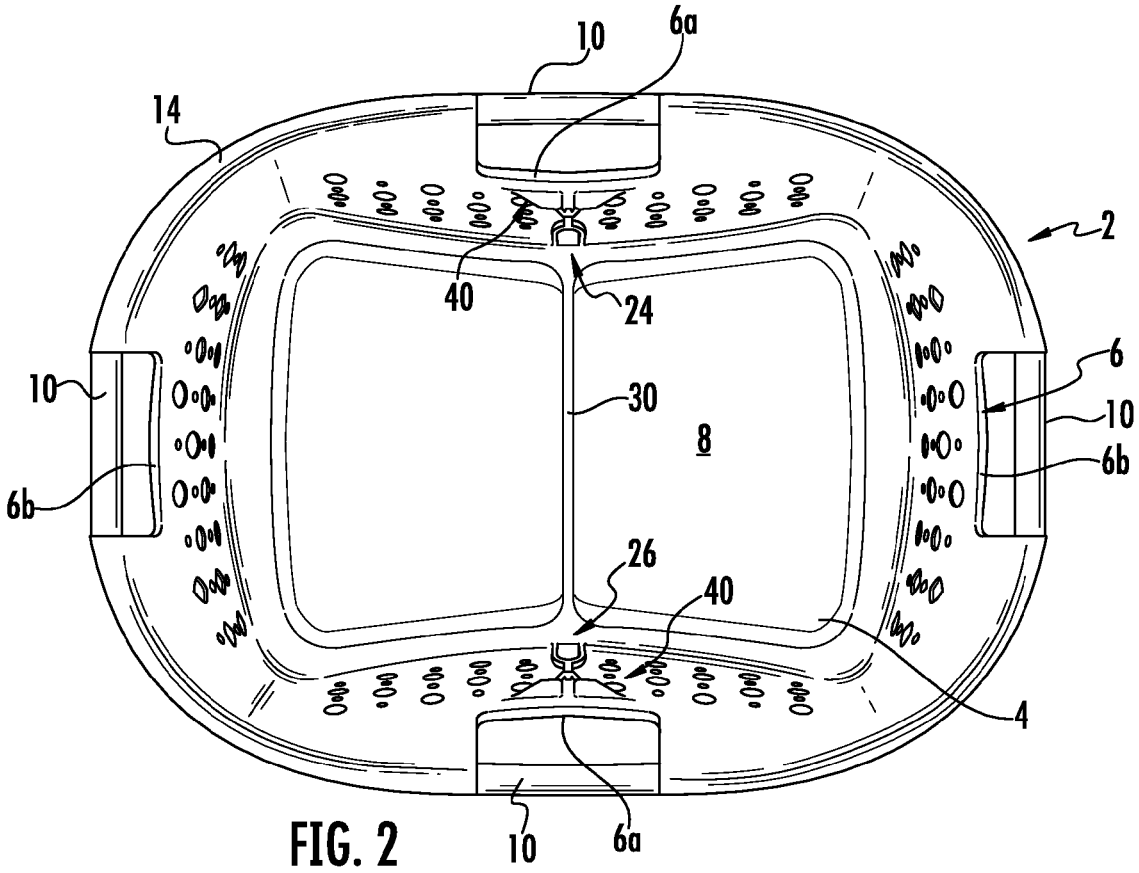
FIG. 2 is a top view of the container of FIG. 1.

In one embodiment, the base 4 of the receptacle 2 is formed with a shape that corresponds to the shape of the divider 12 as shown in FIG. 2. As shown, the base 4 has a narrowest width between the side walls 6*a* at its center and gradually widens toward each end wall 6*b* of the receptacle 2 where the angle at which the base widens is the same as the draft angle of the side walls 6*a*. The tapered "hourglass" or "bowtie" shape of the base 4 allows the divider 12, when it is in the retracted position, to fit within the receptacle 2 and lay flat against the base 4 while allowing the divider to completely span the distance between the side walls 6*a* when it is in the deployed position. In the illustrated embodiment the divider 12 is located at the center of the receptacle 2 such that the container is divided into two equal sized spaces 8*a* and 8*b* when the divider is extended. However, the divider 12 may be located offset from the center of the container such that the container is divided into two unequal sized spaces. Where the divider 12 is located at the center of the container, the base 4 on one side of the divider 12 may be a mirror image of the base 4 on the opposite side of the divider 12. The cross-sectional shape of the interior of the receptacle 2 along the plane of the divider 12 in the deployed position may be the same shape as the base 4 to one side of the divider 12. Further, the cross-sectional shape of the interior of the receptacle 2 along the plane of the divider 12 in the deployed position may be the same as the shape of the divider. By matching these shapes the divider 12 fits closely to the walls of the receptacle 2 in both the deployed and retracted positions and the divider 12 may lay flat against the base 4 in the retracted position.

It is appreciated, however, that other shapes allowing for the same functionality may be utilized (e.g., whereas the basket in FIGS. 1-4 shows curved corners and a tapering middle curve, another shape may be more angular, such that the corners of the base are angled (less than ninety degrees) and the edges of the base meet at the center at a more defined angle. Further, while a specific shapes of the containers are shown and described, numerous changes in the details of the shape may be made.

The divider 12 may be pivoted at the bottom of the divider along pivot axis a-a with the pivot axis a-a being located adjacent the base 4 of the container. The divider 12 may pivot about the pivot axis a-a such that the divider 12 may be rotated between the first storage position and the second deployed position. The pivot may be defined by a first pivot pin 20 that extends from one side of the divider 12 and a second pivot pin 22 that extends from the opposite side of the divider. The first and second pins are aligned on the pivot axis a-a. The pins 20 and 22 may be located near the bottom edge 12*b* of the divider. The bottom edge 12*b* of the divider 12 is formed with reinforcement ribs 28 that extend from the faces of the divider 12 and that are spaced over the width of the divider 12.

The first pin 20 is received in a first elongated slot 24 formed on the side wall 6*a* adjacent the base 4 and the second pin 22 is received in a second elongated slot 26 formed on the opposite side wall 6*a* adjacent the base 4. The slots 24, 26 are arranged such that the long axes of the slots extend away from the base 4 substantially perpendicularly to the base 4. The pins 20, 22 and slots 24, 26 are dimensioned such that the pins may move in the slots along the long axes of the slots and may rotate in the slots. The arrangement of the pins and the slots allows the divider to move away from and toward the base 4.

The base 4 of the receptacle 2 is formed with a slot or channel 30 that is disposed parallel to and generally below the pivot axis a-a and is dimensioned to closely receive the bottom edge 12*b* and reinforcement ribs 28 when the divider 12 is in the deployed position. The channel 30 may be formed as a recess molded into the base 4 or it may be formed in a separate component attached to the base 4. The reinforcement ribs 28 may be fit into the channel 30 such that the divider 12 is partially retained in the deployed position by the engagement of the ribs 28 with the receptacle 2. The reinforcement ribs 28 and channel 30 may be dimensioned such that a relatively tight friction fit is created between the divider 12 and the receptacle 2. The use of the ribs 28 extending from the face of the divider 12 may be used to accommodate small variances in manufacturing tolerances where the ribs may be slightly deformed when inserted into channel 30. While a single channel 30 is shown that extends for substantially the entire width of the divider, the channel may extend for less than the entire width of the divider 12 provided the divider may be engaged with the channel. Further, a plurality of channels may be provided rather than the single channel where the plurality of channels are engaged by a plurality of mating protrusions or edges located along the bottom edge 12*b* of divider 12. Moreover, the arrangement of the components may be reversed such that the male engagement member, such as a protrusion, may be formed on the base 4 and the female engagement member, such as a channel, may be formed in the divider 12. The slots 24 and 26 are dimensioned and positioned such that the pins 20 and 22 may move away from the base 4 a sufficient distance that the bottom edge 12*b* of the divider 12 may be removed from channel 30 and the pins 20 and 22 may be moved toward the base 4 a sufficient distance that the bottom edge 12*b* of divider 12 may be inserted in the channel 30. In one embodiment the bottom edges of the slots 24 and 26 extend to or below the bottom of channel 30 and the top edges of the slots 24 and 26 extend above the top edge of the channel 30.

The upper end of the divider 12 is a retained in position using a locking mechanism such that the divider is held in the deployed position. In one embodiment a locking mechanism 40 is provided on each side wall 6*a* such that both sides of the divider 12 are held in position. The locking mechanisms 40 are the same such that one locking mechanism 40 will be described. The locking mechanism 40 may comprise a first locking member on the divider that engages a second locking member on the container. One of the locking members may comprise a male member and the other locking member may comprise a female member that is engaged by the male member. In one embodiment, one locking member comprises a channel 42 formed on the side wall that receives and retains at least a portion of the side edge 12*a* of the divider 12 when the divider is in the deployed position. The channel 42 may be formed by a first block 44 and a second block 46 that are spaced from one another to create the channel 42 between the blocks. The blocks may be formed as raised areas molded into the walls of the receptacle or the blocks may be separate components attached to the walls of the receptacle. Alternatively, the channels may be formed as recesses that are molded or otherwise formed in a flat surface of the side walls. Each block may be formed as a ramp where the surfaces 44*a* and 46*a* of the blocks 44 and 46 extend gradually away from the surface of the side wall 6*a* to the channel 42. The mating locking member may comprise the side edges 12*a* of the divider 12. The side edges of divider 12 may be fit into the channels 42 such that the divider 12 is retained in the deployed position by the engagement of the divider 12 with channels 42. The side edges 12*b* may be provided with protrusions 48 that extend into the channels 42. In one embodiment the channels 42 are disposed perpendicular to the base 4. The divider 12 and channels 42 may be dimensioned such that the divider 12 may move in the channels 42 toward and away from base 4 but is otherwise constrained in the channel. Moreover, the male member, such as a protrusion, may be formed on the receptacle 2 and the female member, such as a channel, may be formed in the divider to receive the protrusion.

In operation the divider 12 may be moved from the retracted position where it lays against the base 4 to the raised position by rotating the divider 12 about pivot axis a-a on pins 20, 22. As the divider 12 is rotated, the pins 20, 22 are moved to the tops of the slots 24, 26 such that the bottom edge 12*b* of the divider 12 is moved away from the base 4. As the divider 12 moves toward the locking mechanisms 40 the edges 12*a* of the divider 12 engage the ramped surfaces of the blocks 44, 46 such that the divider 12 and/or the side walls may be deformed slightly such that the divider may pass over the locking mechanisms 40 and engage the channels 42. When the divider 12 reaches the deployed position, the divider and/or the side walls return to the undeformed condition where the side edges 12*a* of the divider are positioned in the channels 42 as shown in FIG. 3. Once the side edges 12*a* of the divider 12 enter the channels 42, the divider 12 is pushed downward toward the base 4 such that the lower edge 12*b* of the divider 12 is forced into the bottom channel 30 as shown in FIG. 4. In this position the divider 12 is locked in the container in the deployed position. In an alternate embodiment, the divider 12, as it is rotated from the storage position to the deployed position, may be lifted a sufficient distance that the protrusions 48 on divider 12 clear and pass over the top of the locking members 40. The protrusions 48 of the divider 12 may then be slid into the side channels 42 from above, rather than being forced between the ramped blocks 44, 46.

To move the divider 12 from the deployed position to the storage position, the divider 12 is lifted away from the base 4 such that the bottom edge 12*b* is removed from the bottom channel 30. The elongated slots 24, 26 allow the pins 20, 22 to move away from the base 4 a sufficient distance that the bottom edge 12*b* may be removed from the channel 30. The divider 12 is then rotated toward the base 4 such that the protrusions and/or side edges of the divider 12 are removed from the side channels 42. The divider 12 may be rotated and laid flat against the base 4.

Figure 11:
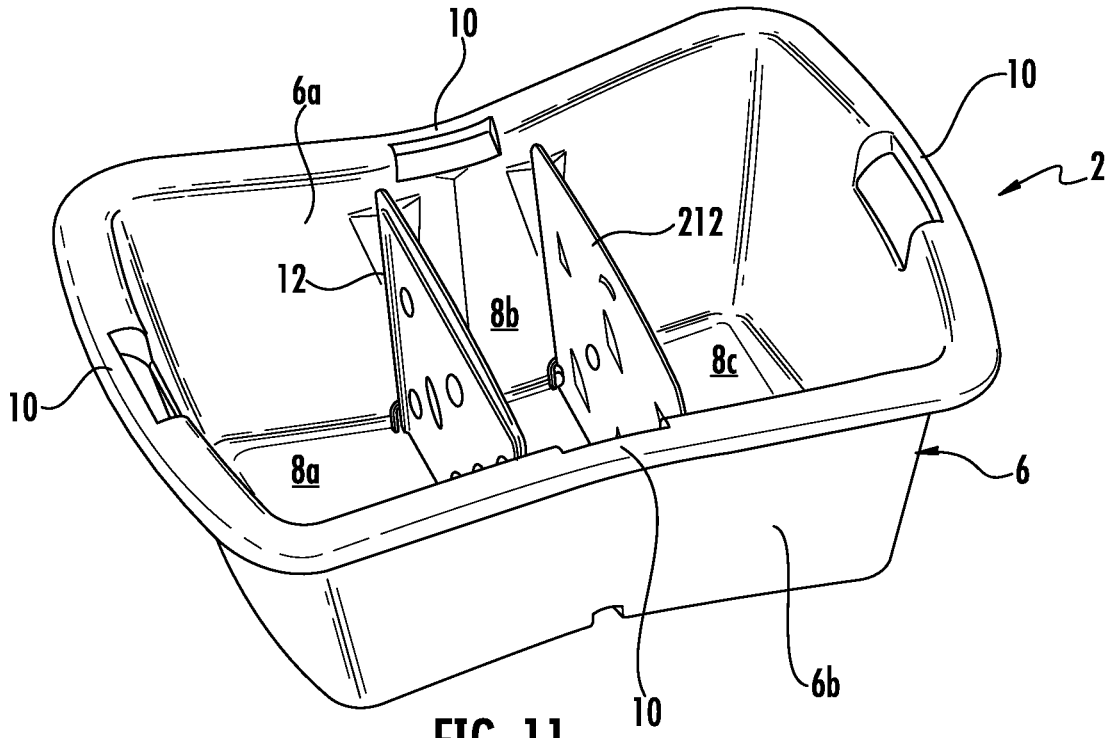
FIG. 11 is a perspective view of another embodiment of a container of the invention.
Figure 12:
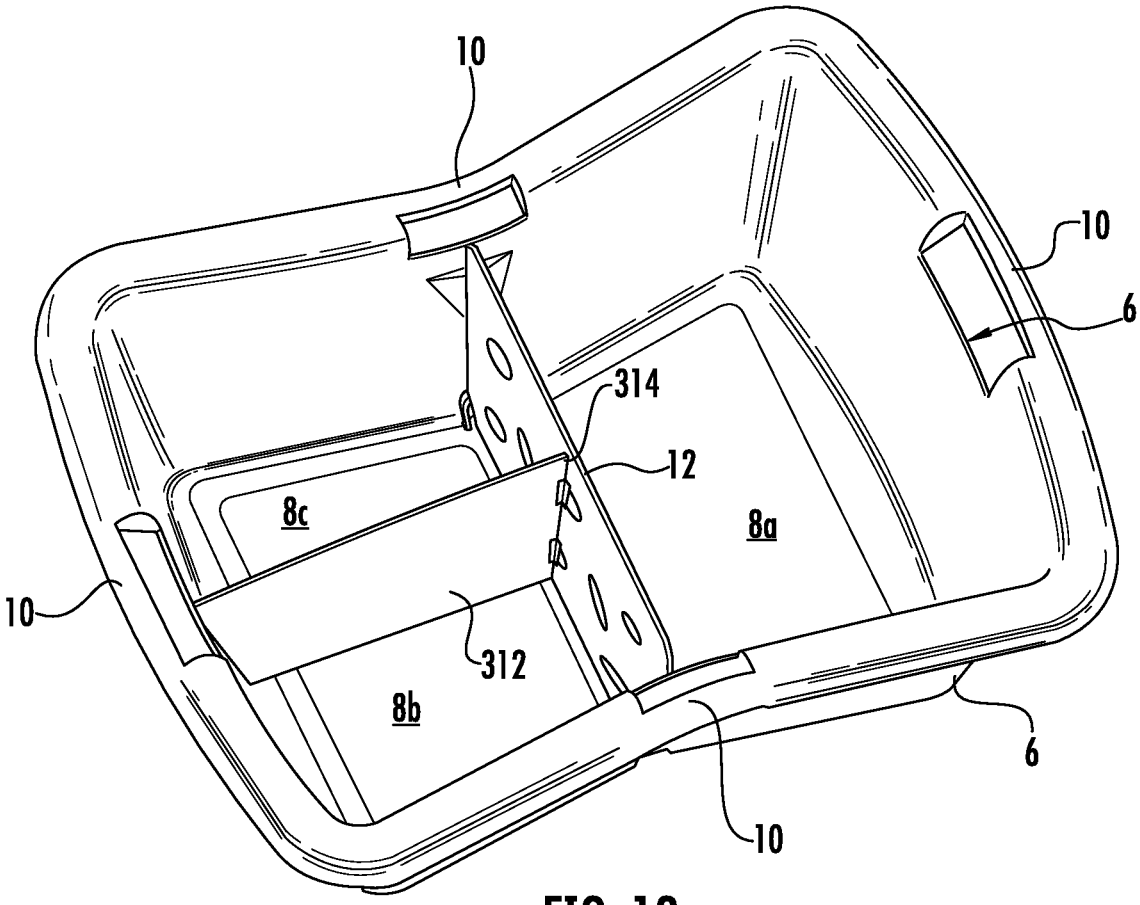
FIG. 12 is a perspective view of yet another embodiment of a container of the invention.

Referring to FIG. 11, in an alternate embodiment two dividers 12 and 212 are used where each divider can fold down to opposing sides of basket and rotate to the deployed position to divide the interior space into three sections 8*a*, 8*b* and 8*c*. In another embodiment of a two divider system, shown in FIG. 12, the interior of the basket may be divided into three sections 8*a*, 8*b* and 8*c* using one divider 12 in the middle of the basket to separate the interior of the basket into two sections, as previously described, and a second divider 312 pivoted to the first divider 8*a* at a hinge 314 to separate one half of the basket into two smaller sections 8*b* and 8*c*.

Another embodiment of a container of the invention is shown in FIGS. 13 through 21 and comprises an upstanding receptacle 102 having a base 104 from which a wall 106 extends to create an interior space 108. The receptacle 102 may be used as a laundry hamper and may have a wall 106 that is taller than the wall 6 of the laundry basket described with respect to FIG. 1 such that the hamper has a greater volume than the laundry basket. The base 104 may also be supported on wheels, casters or the like 111 such that the hamper may be rolled over the floor by a user. While the container of FIGS. 13 through 21 is described as a hamper for retaining articles such as clothes the container may have other functions and may contain articles other than clothes. Further, while the wall 106 and base 104 define a generally rectilinear shape where the wall 106 is defined by generally planar side walls 106*a* and end walls 106*b* the container may have a wide variety of shapes and sizes. The container may be formed of plastic and may be made by a molding operation such as injection molding, blow molding or the like. While in a preferred embodiment the container is made of plastic the container may be made of any suitable material. Further, opposed walls may be formed with a handles or hand grips 110 to facilitate the carrying of the container. The container may be formed with a greater or fewer number of handles and the handles may be positioned at various locations on the container. The wall 106 may comprise a wide variety of decorative finishes and motifs.

The container of the invention further comprises a movable divider 112 that may be used to subdivide the interior space 108 into two or more subspaces 108*a*, 108*b* such that the receptacle 102 may be used to segregate articles in the plurality of subspaces 108*a*, 108*b*. In one embodiment, the divider 112 comprises a planar member that is mounted for movement relative to the receptacle 102 such that it may move between a first storage position where the interior space 108 is maintained as a large undivided space and a second deployed position where the interior space 108 is subdivided into a plurality of subspaces 108*a*, 108*b*. In the illustrated embodiment, the divider 112 is mounted for translational movement such that in the first position the divider 112 lays flat against one end wall 106*b* of the receptacle 102 and in the second position the divider extends between opposed side walls 106*a* at a location between the opposing end walls 106*b*. The divider 112 is dimensioned such that the divider 112 extends between the opposing side walls 106*a* to divide the receptacle into separate spaces 108*a*, 108*b*. The divider 112 may be made with a complementary shape to the interior space of the receptacle such that the divider 112, when in the extended second position extends completely between the opposed side walls 106*a* such that the side edges 112*a* of the divider 112 are closely adjacent to the side walls 106*a*.

The divider 112 may be mounted for translational movement relative to the receptacle 102 by using a shroud 150. The shroud 150 may be snap-fit onto the receptacle 102 to define a pair of opposed tracks 152 that slidably receive followers 153 on the divider 112 such that the divider may be slid in the tracks 152 between the retracted position and the deployed position. The shroud 150 may be removably mounted on the receptacle such that the divider 112 is removable from the receptacle 102 or the shroud 150 may be permanently attached to the receptacle 102. The shroud 150 may be attached to the receptacle 106 by any suitable connector including, but not limited to, separate fasteners, such as screws, adhesive, welding, friction fit or the like.

Figure 16:
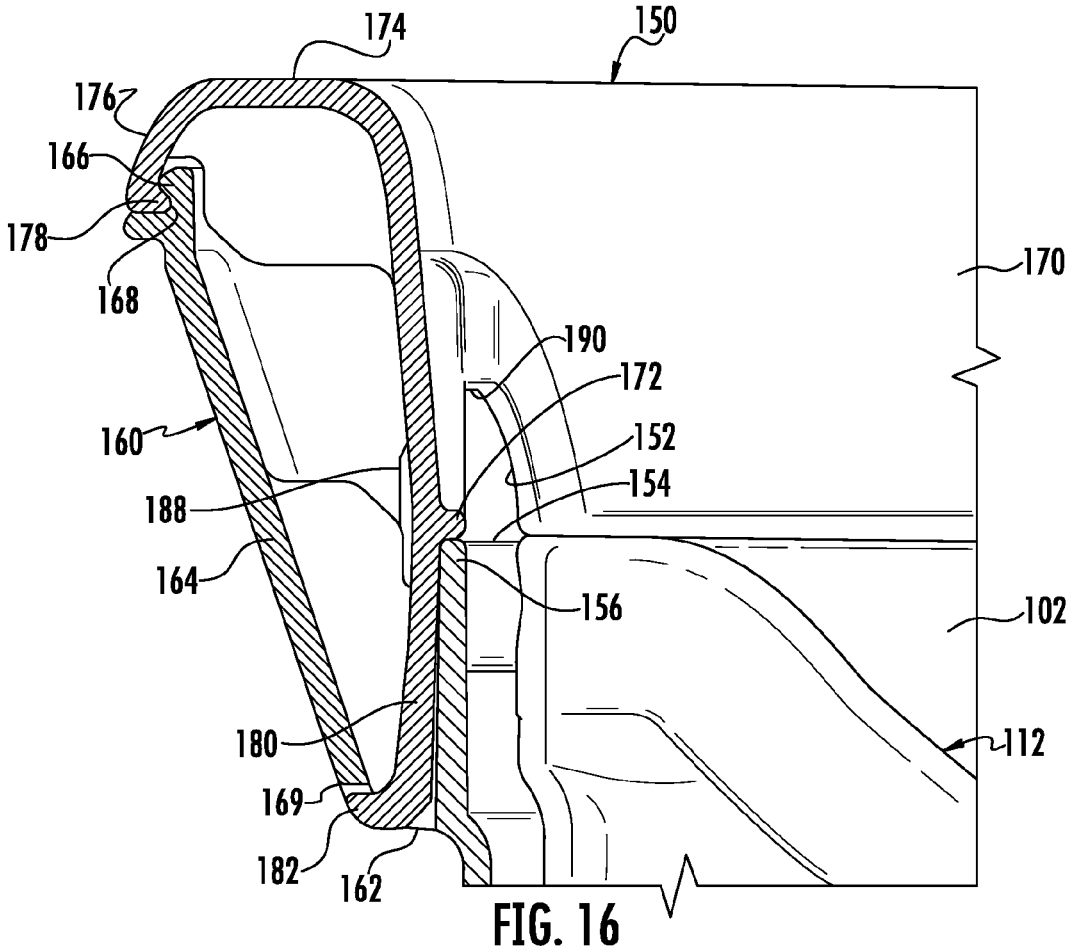
FIG. 16 is a detailed section view of the container of FIG. 13.
Figure 17:
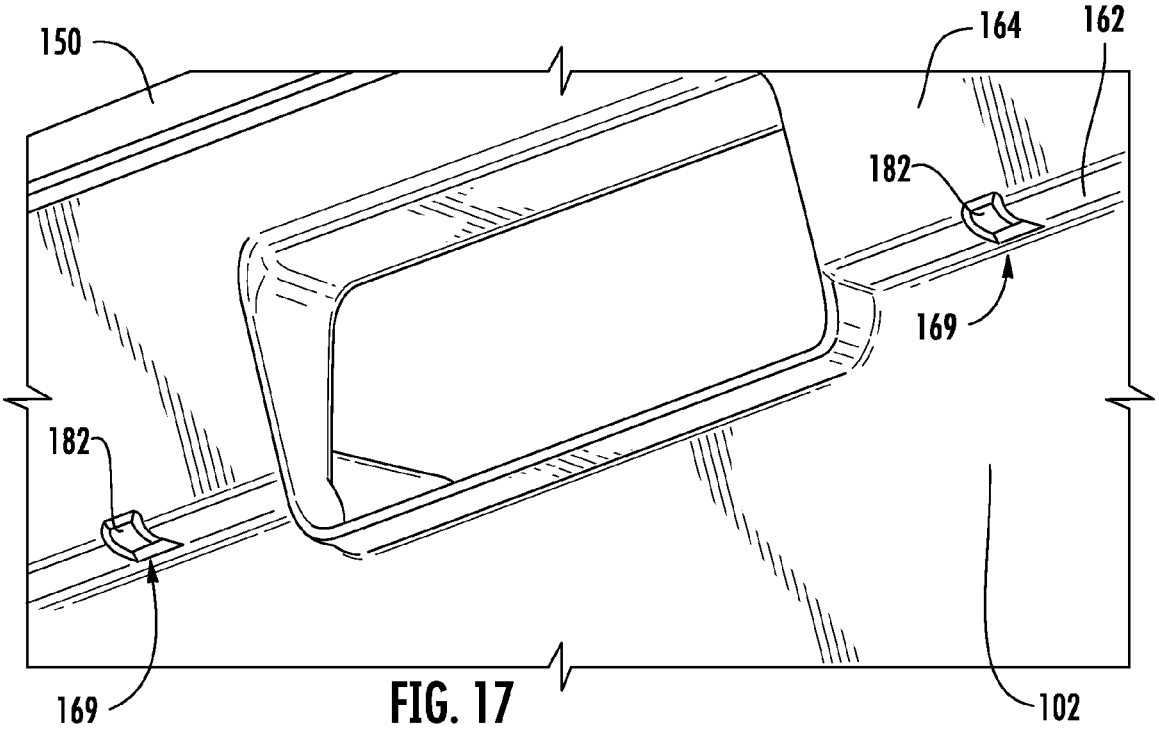
FIG. 17 is a detailed perspective view of the receptacle used in the container of FIG. 13.

Referring to FIG. 16 the top of the receptacle 102 terminates in a top edge 156 that defines a generally horizontal runner on which the retainer flanges 154 of the divider 112 are supported and ride on during positioning of the divider 112. A flange 160 surrounds the top edge 156 of the receptacle 102 that engages the shroud 150 such that the shroud is secured to the receptacle 102. The flange 160 comprises a first portion 162 that extends generally horizontally, outwardly away from the wall 106 of the receptacle 102 and that supports a second portion 164 that extends upwardly and outwardly from the first portion 162. The upper edge of the flange 160 is formed with a lip 166 that creates a recess 168 for receiving a mating edge of the shroud 150. The first portion 162 of the flange 160 is formed with a plurality of spaced apertures 169 that receive mating locking members on the shroud 150.

Figure 13:
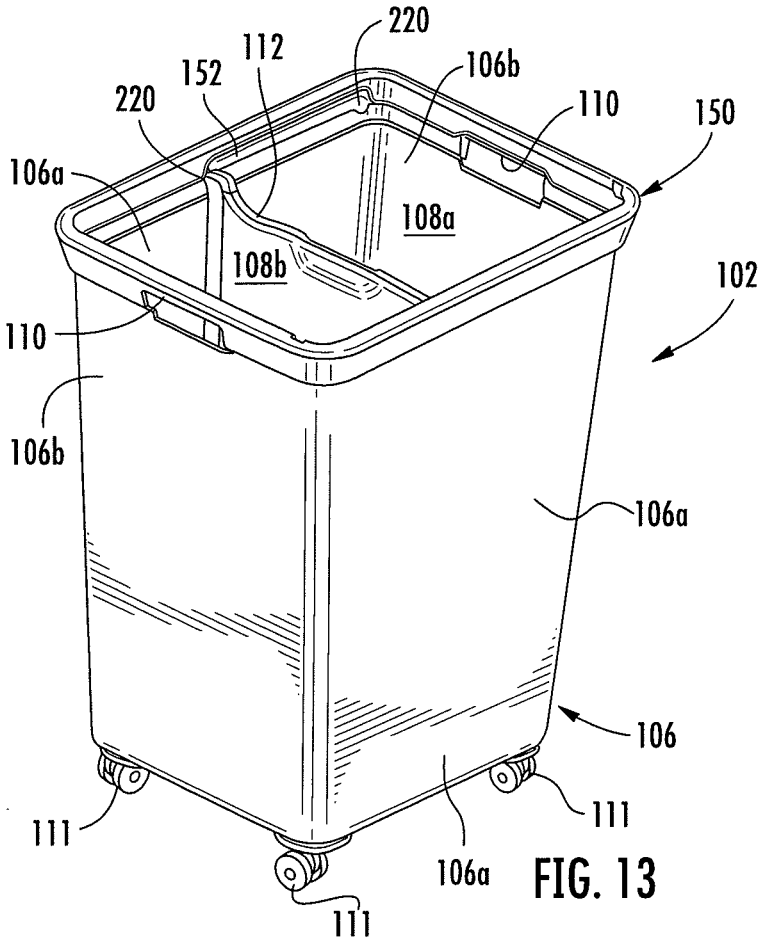
FIG. 13 is a perspective view of still another embodiment of a container of the invention.
Figure 14:
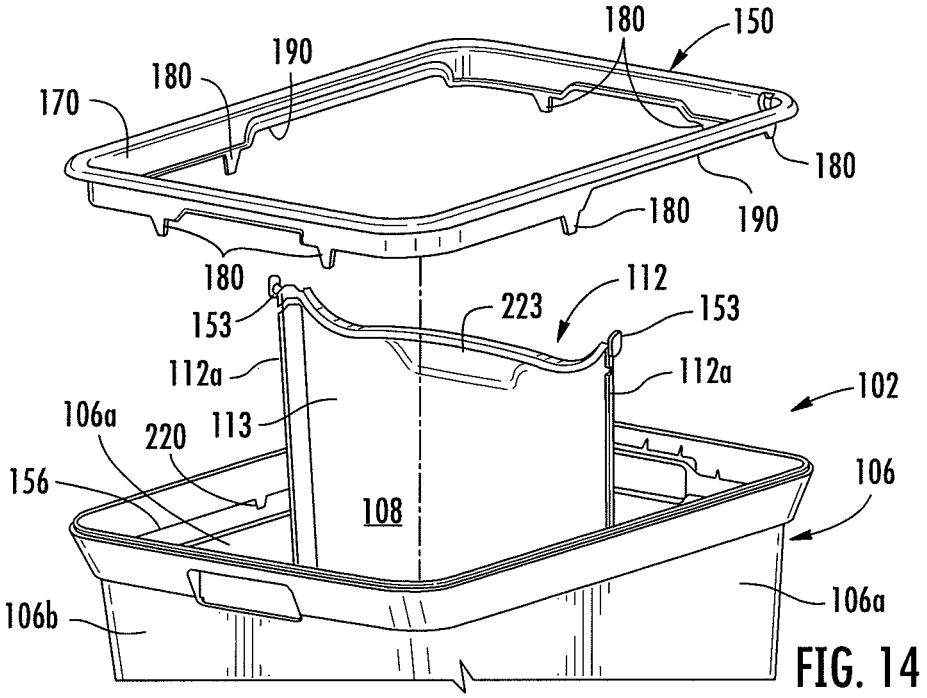
FIG. 14 is an exploded view of the container of FIG. 13.
Figure 15:
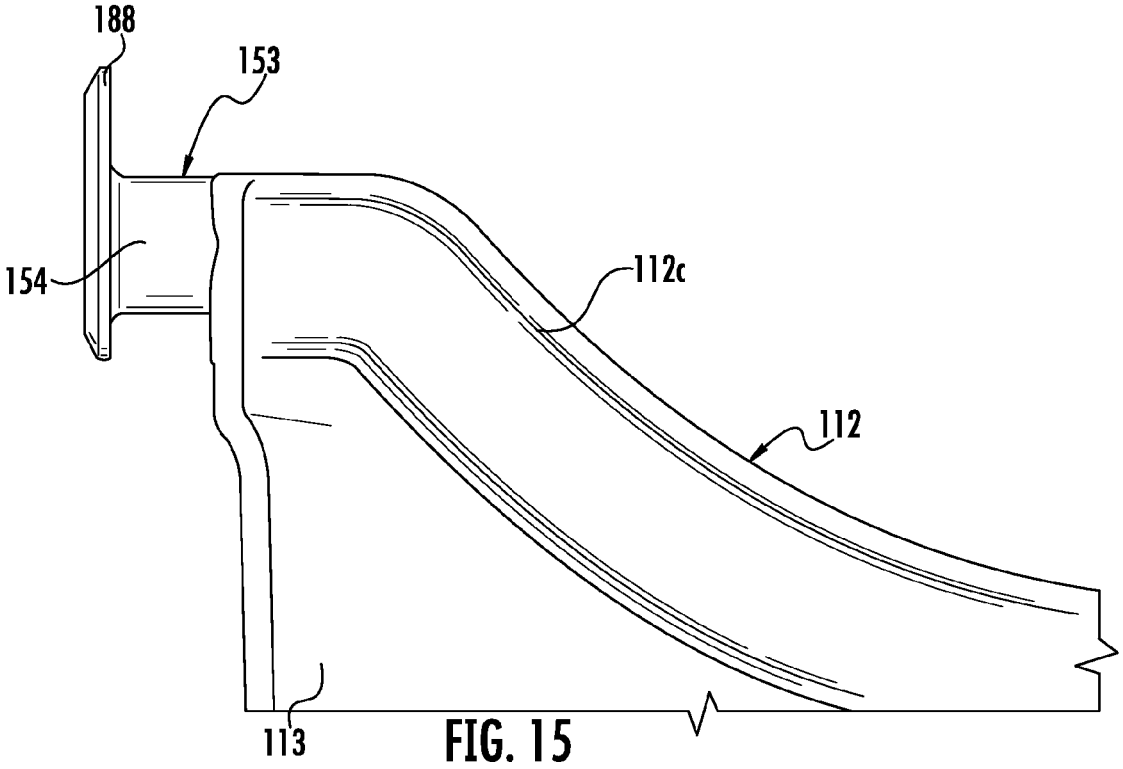
FIG. 15 is a detailed side view of the divider used in the container of FIG. 1.

As shown in FIGS. 13, 14 and 16, the shroud 150 comprises an internal wall 170 that is substantially coextensive with the wall 6 of the receptacle 102. The wall 170 comprises a lip 172 that extends about at least a portion of the periphery of the shroud 150 and that seats on the top edge 156 of the wall 106 of the receptacle 102 when the shroud 150 is attached to the receptacle 102. The shroud 150 further comprises a rim 174 that fits over the flange 160 on the receptacle 102 and that includes a downturned flange 176 comprising a lip 178. The flange 176 may be forced over the flange 160 on the receptacle 102 to deform flange 176 and/or flange 160 such that the lip 178 engages and is retained in the recess 166 formed on the outer surface of the flange 160. The shroud 150 also comprises a plurality of fingers 180 that engage the plurality of apertures 169 formed on the receptacle 102 such that a distal end 182 of the fingers 180 can engage an edge 184 of the apertures 169. The distal ends 182 of the fingers 180 may be provided with engagement structures such as hooks that engage the edge of apertures 169. In use the shroud 150 is positioned over the receptacle 102 such that the fingers 180 are positioned above the apertures 169. The shroud 150 is forced down onto the flange 160 such that the fingers 180 deform and engage the edge of the apertures 169 and the flange 176 and/or flange 160 deform such that the lip 178 passes over the lip 164 and engages the recess 166 to create a snap-fit connection between the shroud 150 and the receptacle 102.

An elongated recess 190 is formed on opposing sides of the bottom edge of the internal wall 170 of the shroud 150 such that when the shroud 150 is mounted on the receptacle 102 opposed gaps are created between the interior wall 170 of the shroud 150 and the top edge 156 of the receptacle 102 that extend along at least portion of the side walls 106*a* of the receptacle 102. The gaps are disposed opposite to one another along the side walls 106*a* of the receptacle 102 and define the tracks 152 that receive the retainer flanges 154 of the divider 112 as will be described.

The divider 112 comprises a generally planar member 113 having a top edge 112*c*. Followers 153 extend into tracks 152 such that the followers are free to move along the tracks. The followers 153 comprise oppositely extending retainer flanges 154 extend laterally from planar member 113. The retainer flanges 154 extend into the tracks 152 formed between the receptacle 102 and the shroud 150 and are retained in the tracks 152 by the enlarged head 188 that is trapped behind the shroud and receptacle. To assemble the container, the divider 112 is located in the receptacle 102 with the retainer flanges 154 resting on the upper edges 156 of the opposed side walls 106*a* of receptacle 102. The shroud 150 is then placed on the container and forced downward such that the rim 174 and fingers 180 on the shroud 150 engage the flange 160 and apertures 169 on the receptacle 102, respectively. The retainer flanges 154 are trapped between the shroud 150 and the receptacle 102 but are free to translate in the tracks 152.

Figure 20:
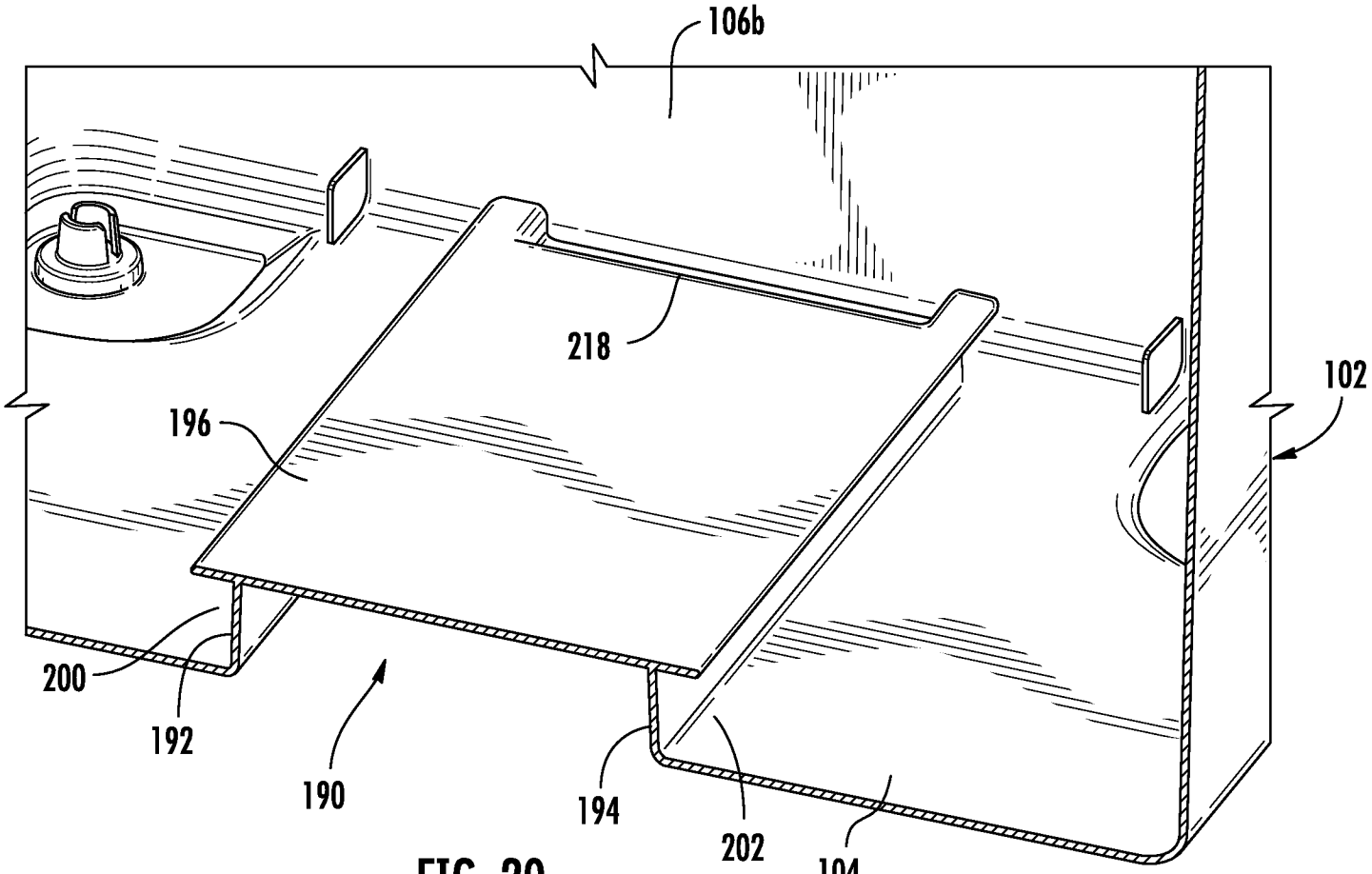
FIG. 20 is a detailed perspective section view of the receptacle used in the container of FIG. 13.
Figure 21:
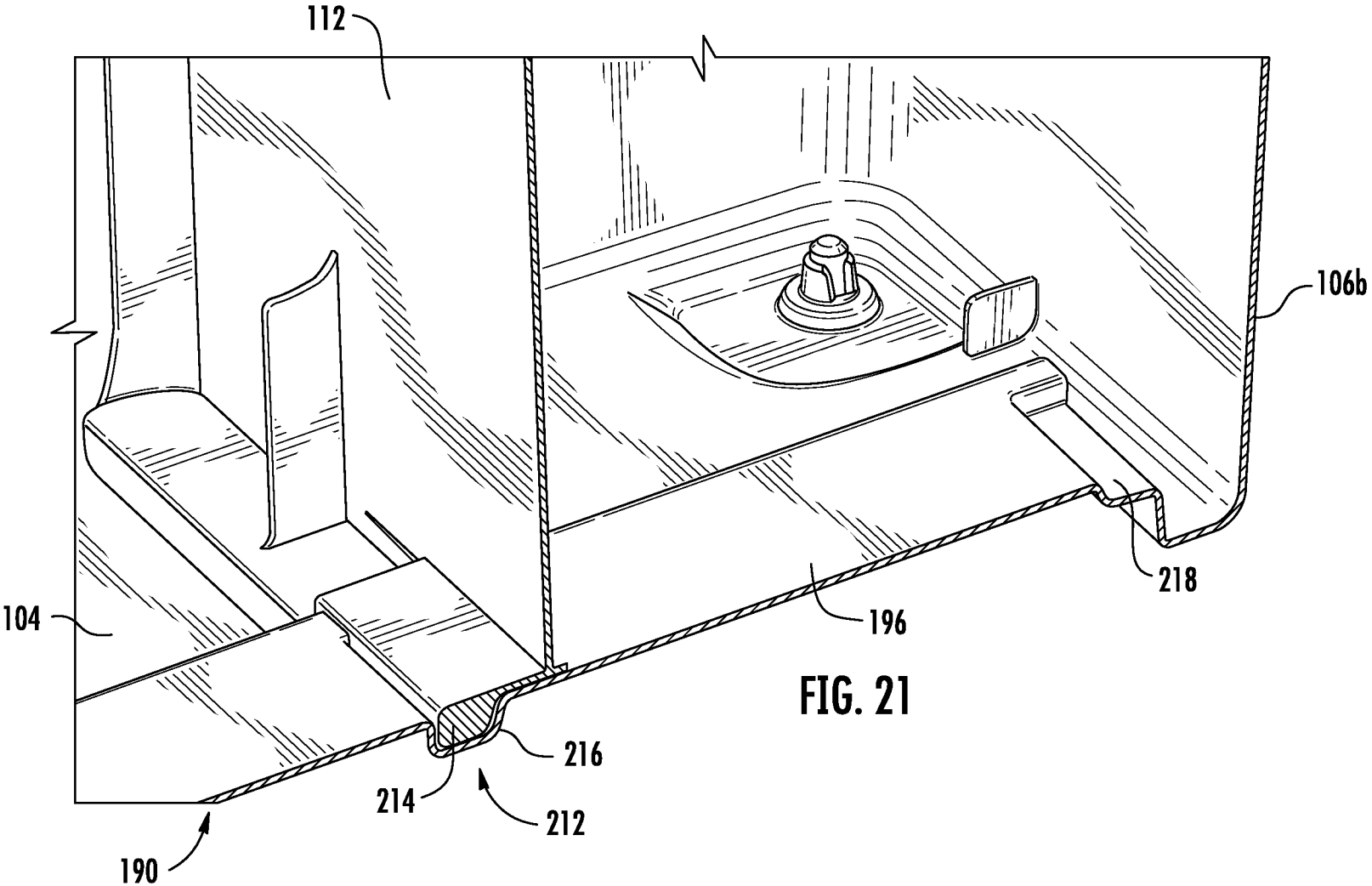
FIG. 21 is a detailed perspective section view of the container of FIG. 13.

Referring to FIGS. 20 and 21, the base 104 of the receptacle 102 comprises a track 190 that extends in the same direction as the tracks 152 formed along the top of the container. In one embodiment, the track 190 is formed by a raised centrally located platform that comprises a first substantially vertical wall 192 and a second substantially vertical wall 194 connected by a top wall 196. The top wall 196 extends beyond the first vertical wall 192 and second vertical wall 194 to create parallel outwardly facing grooves or channels 200 and 202.

Figure 19:
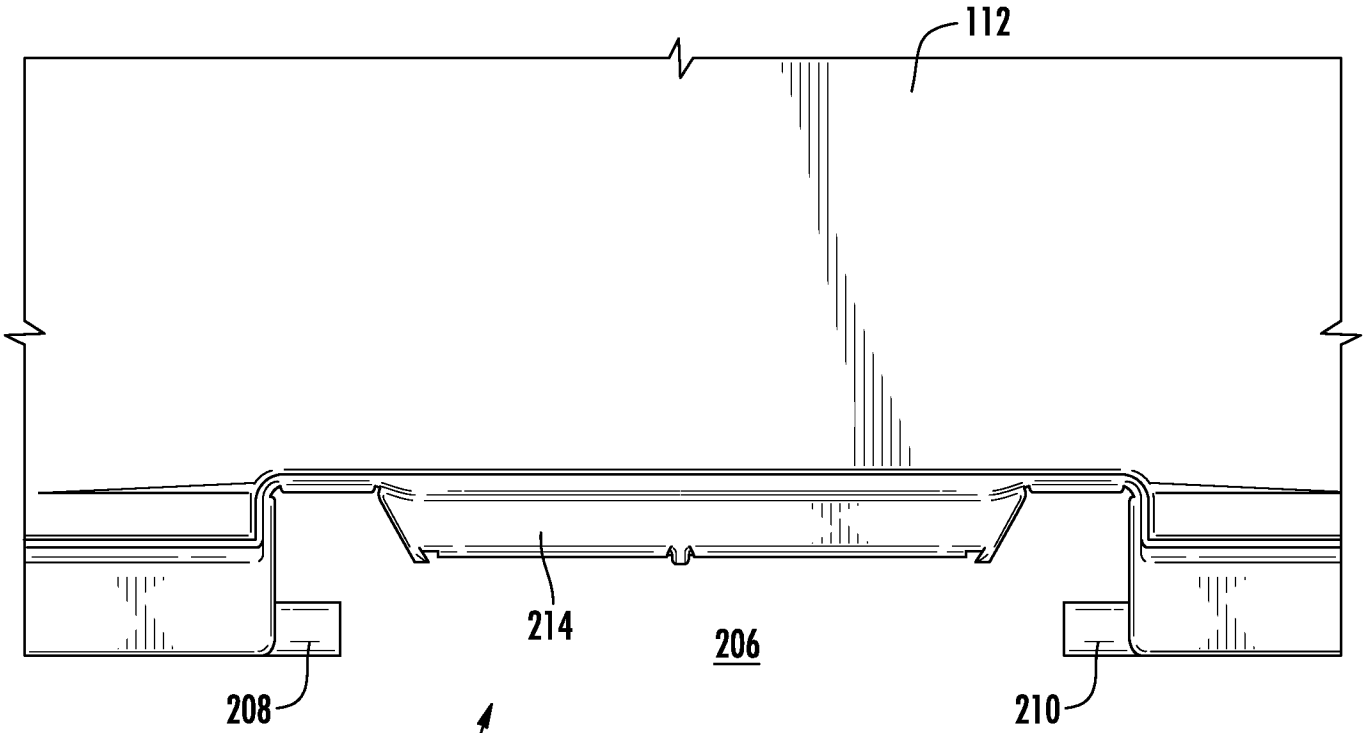
FIG. 19 is a detailed side view of the divider used in the container of FIG. 1.

Referring to FIG. 19, the divider 112 is provided with a mating follower 204 that engages the track 190 to guide the divider 112 along the track. In the illustrated embodiment the follower 204 comprises a centrally located recess 206 that receives the track 190. Inwardly directed pins 208 and 210 extend into the channels 200 and 202, respectively, such that the divider 112 may translate along the track 190 but is otherwise constrained on the track.

Figure 22:
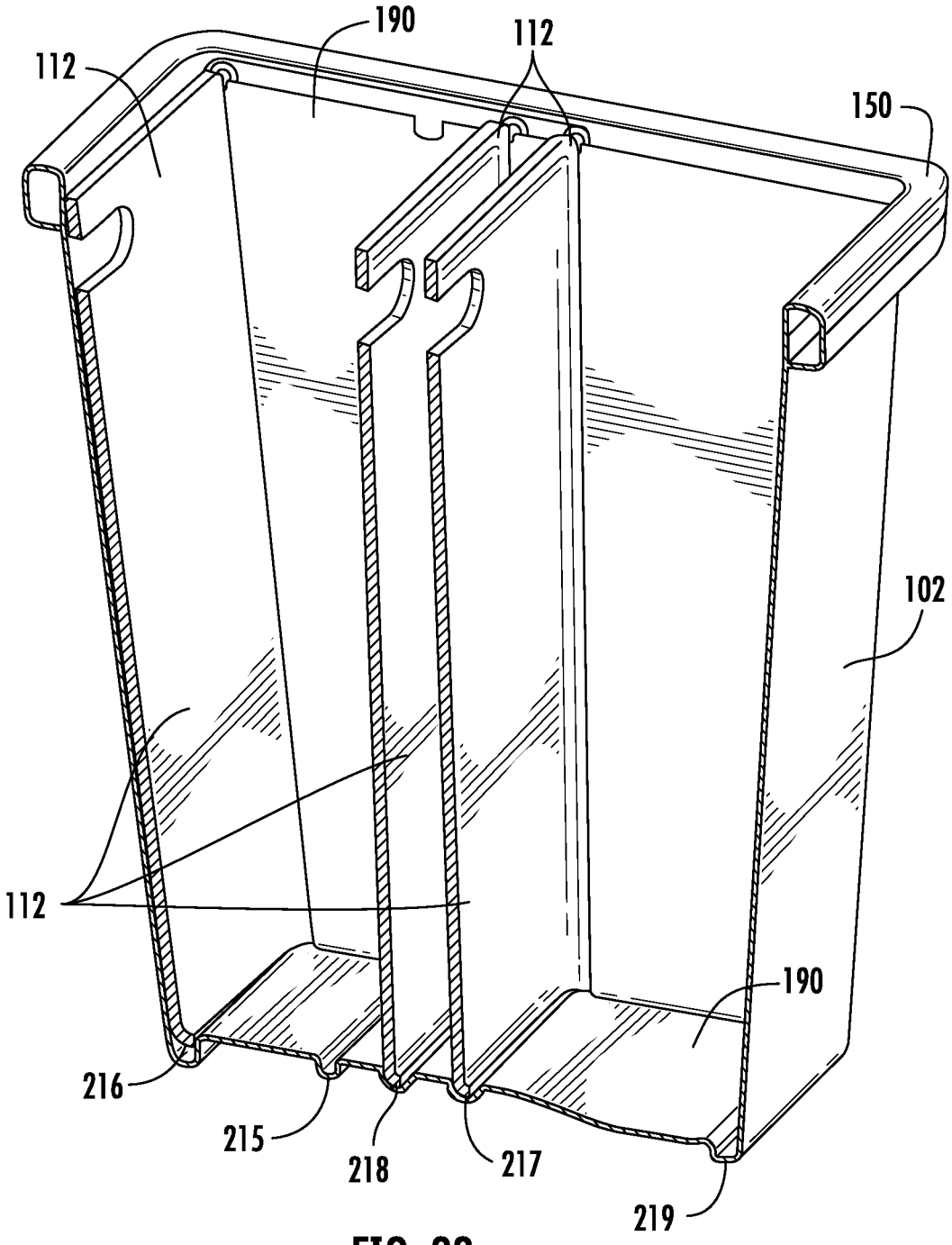
FIG. 22 is a perspective section view showing another embodiment of the container of the invention.

The divider 112 and receptacle 102 further include a lower locking mechanism 212 that locks the bottom portion of the divider 112 relative to the container. The locking mechanism 212 may comprise a first locking member on the divider that engages a second locking member on the receptacle. One of the locking members may comprise a male member and the other locking member may comprise a female member that is engaged by the male member. In one embodiment one locking member comprises a downwardly extending protrusion 214 on the divider 112. Protrusion 214 may be located in the recess 206. The other locking member may comprise mating upwardly facing grooves or channels 216, 218 formed in the receptacle 102 for receiving protrusion 214 to temporarily lock the divider 112 in the desired position. In one embodiment the channels 216, 218 are formed in the top surface 196 of the track 190. While the locking member on the divider is shown as a protrusion 214 and the mating locking members on the track are shown as recesses 216, 218, these members may be reversed such that a recess is formed on the divider 112 and the protrusions are formed on the receptacle 102. Further, these members may have a variety of shapes and may be located at different positions on the divider and container. The locking members on the receptacle 102 may be located at any position where it is desired to temporarily lock the divider. In the illustrated embodiment, a first channel 218 is located adjacent to an end wall 106*b* and a second channel 216 is located at the center of the container at a point midway between the end walls 106*b*. As a result, the divider may be locked in a retracted position adjacent the one end wall 106*b* and in a central position that divides the container into two equal spaces 108*a* and 108*b*. While the deployed second position is shown at the center of the container, this position may be offset to one side such that the container is divided into two unequal spaces. Further, a greater or fewer number of locking members 215, 217 and 219 may be provided on the receptacle 102 such that the divider 112 may be locked in other than two positions as shown in FIG. 22. Further, more than one divider 112 may be used to divide the space 108 into more than two subspaces as also shown in FIG. 22.

Figure 18:
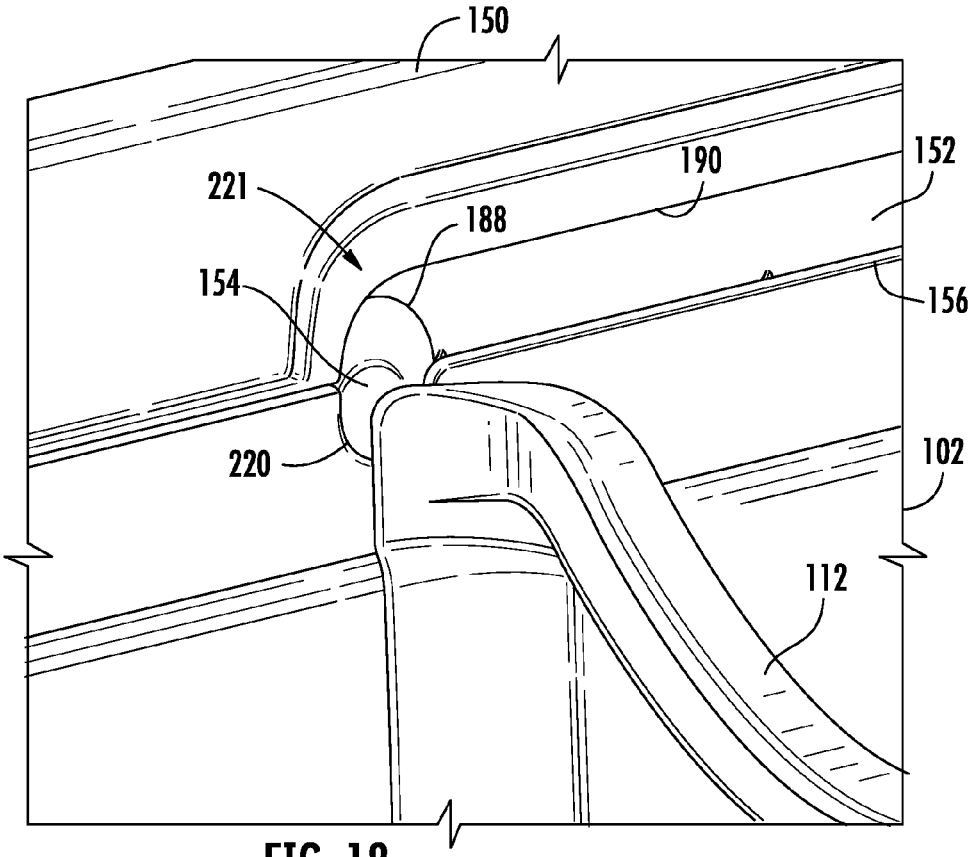
FIG. 18 is a detailed perspective view of the container of FIG. 13.

To hold or lock the upper end of the divider in the desired position, an upper locking mechanism 221 may be provided as shown in FIGS. 13, 14 and 18. The upper locking mechanism 221 may comprise a first locking member such as upwardly opening recesses 220 that may be formed in the upper tracks 152 in substantial vertical alignment with the channels 216, 218. The recesses may be formed in the top edge 156 of the receptacle 102 and are dimensioned to receive a second locking member such as the retainer flange 154. When the divider is positioned such that the protrusion 214 is located over one of the channels 216, 218 the retainer flanges 154 are positioned over one of the recesses 220. When the user pushes down on the divider to insert the protrusion 214 in the desired channel 216, 218 the retainer flanges 154 are simultaneously inserted into corresponding recesses. While the locking member on the divider is shown as a male member 154 and the mating locking members on the tracks 152 are shown as recesses 220, these members may be reversed such that a recess is formed on the divider 112 and the protrusions are formed on the receptacle 102. Further, these members may have a variety of shapes and may be located at different positions on the divider and container. The engagement of the retainer flanges 154 with the upper recesses 220 and the engagement of the locking mechanism 212 fixes the divider in the desired position. The arrangement of the upper locking mechanisms 221 and the lower locking mechanisms 212 allows the divider to be locked in position by moving the divider toward the base and allows the divider to be unlocked by moving the divider away from the base where a single motion of the divider locks and unlocks both the upper and lower locking mechanisms.

To move the divider 112 the user grips the upper edge 112*c* of the divider. The upper edge of the divider may be provided with a hand grip 223 for this purpose. The user raises the divider 112 to disengage the lower locking mechanism 212 and the upper locking mechanism 221 allowing the divider 112 to slide in tracks 152 to the desired position. The user pulls or pushes on the divider 112 to move the divider in the desired direction to the desired position. When the divider 112 is located in the desired position, the user presses down on the divider 112 to engage the lower locking mechanism 212 and the upper locking mechanism 221.

Although specific embodiments have been illustrated and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A container comprising:

a receptacle defining a space, the receptacle comprising a base and opposing side walls where the side walls angle outwardly at a draft angle as the side walls extend away from the base;

a divider mounted to the receptacle such that the divider rotates between a first position and a second position such that when the divider is in the first position the space defines a single space and when the divider is in the second position the divider defines two spaces, the divider is dimensioned such that the divider extends between the opposing side walls in the first position and the second position wherein a cross-sectional shape of the receptacle along the plane of the divider in the second position is the same shape as the base to one side of the divider.

2. The container of claim 1 wherein the divider comprises side edges that extend outwardly from a bottom edge such that when the divider is in the second position the side edges are closely spaced from the opposed side walls along the entire length of the side edges.

3. The container of claim 1 wherein the receptacle comprises opposing end walls and the base has a narrowest width at a position between the opposing end walls and widens at an angle toward at least one of the opposing end walls where the angle at which the base widens is the same as the draft angle.

4. The container of claim 3 wherein the divider is located at the center of the receptacle such that the container is divided into two equal sized spaces when the divider is in the second position.

5. The container of claim 1 wherein the cross-sectional shape of the receptacle along the plane of the divider in the second position is the same as the shape of the divider.

6. The container of claim 1 wherein the divider is pivoted on a pivot.

7. The container of claim 1 wherein the divider rotates between the first position and the second position about a pivot, the pivot comprises a pivot pin, the pivot pin being received in a slot, the pin and slot being dimensioned such that the pin may move in the slot toward and away from the base.

8. The container of claim 1 wherein a channel is provided on the base and is dimensioned to closely receive a bottom edge of the divider when the divider is in the second position.

9. The container of claim 8 wherein the divider comprises reinforcement ribs that are dimensioned to fit into the channel.

10. The container of claim 9 further comprising a locking mechanism for holding the divider in the second position and allowing the divider to move toward and away from the base.

11. The container of claim 10 wherein the locking mechanism is disposed such that moving the divider towards the base moves the lower edge of the divider into the channel and moving the divider away from the base removes the lower edge of the divider from the channel.

12. The container of claim 10 wherein the locking mechanism comprises a first locking member on the divider that engages a second locking member on the container wherein one of the first locking member and the second locking member comprises a second channel wherein the divider is able to move along the second channel relative to the receptacle.

13. A container comprising:

a receptacle comprising a base and a wall defining a space;

a divider mounted to the receptacle such that the divider translates between a first position and a second position such that when the divider is in the first position the space defines a single space and when the divider is in the second position the divider defines two spaces;

a first locking mechanism for locking a bottom portion of the divider relative to the receptacle in at least the second position, the first locking mechanism comprising a first locking member on the divider and a second locking member on the receptacle where a first one of the first locking member and the second locking member comprise a male member and a second one of the first locking member and the second locking member comprise a female member, the first locking member and the second locking member engaging one another when the divider is moved toward the base; and a second locking mechanism for locking a top portion of the divider relative to the receptacle in at least the second position, the second locking mechanism comprising a track for linearly supporting an upper end of the divider and a third locking member on the divider and a fourth locking member on the receptacle where a first one of the third locking member and the fourth locking member comprise a male member and a second one of the third locking member and the fourth locking member comprise a female member, the fourth locking member being substantially vertically aligned with the second locking member, the third locking member and the fourth locking member engaging one another when the divider is moved toward the base.

14. The container of claim 13 wherein the divider is positioned against an end wall of the receptacle in the first position and is positioned spaced from the end wall in the second position.

15. The container of claim 13 wherein the track comprises a recess that defines the third locking member for receiving a portion of the divider when the first locking member engages the second locking member.

16. The container of claim 15 further comprising a plurality of second locking members and a plurality of recesses formed in the track, one of the plurality of recesses being in substantial vertical alignment with each one of the plurality of second locking members.

17. A container comprising:

a receptacle defining a space, the receptacle comprising a base and opposing side walls where the side walls angle outwardly at a draft angle as the side walls extend away from the base;

a divider mounted to the receptacle such that the divider rotates between a first position and a second position such that when the divider is in the first position the space defines a single space and when the divider is in the second position the divider defines two spaces, wherein the receptacle comprises opposing end walls and the base has a narrowest width at a position between the opposing end walls and widens at an angle toward at least one of the opposing end walls where the angle at which the base widens is the same as the draft angle.

18. A container comprising:

a receptacle defining a space, the receptacle comprising a base and opposing side walls where the side walls angle outwardly at a draft angle as the side walls extend away from the base;

a divider mounted to the receptacle such that the divider rotates between a first position and a second position such that when the divider is in the first position the space defines a single space and when the divider is in the second position the divider defines two spaces wherein the cross-sectional shape of the receptacle along the plane of the divider in the second position is the same as the shape of the divider.

19. A container comprising:

a receptacle defining a space, the receptacle comprising a base and opposing side walls where the side walls angle outwardly at a draft angle as the side walls extend away from the base;

a divider mounted to the receptacle such that the divider rotates between a first position and a second position such that when the divider is in the first position the divider is adjacent the base and the space defines a single space and when the divider is in the second position the divider defines two spaces, wherein the divider comprises side edges that extend outwardly from a bottom edge such that when the divider is in the second position the side edges are closely spaced from the opposed side walls along the entire length of the side edges.

* * * * *